United States Patent [19]

Appell

[11] Patent Number: 5,027,839

[45] Date of Patent: Jul. 2, 1991

[54] PROTECTIVE DEVICE FOR USE IN REMOVING FINGERNAIL POLISH

[76] Inventor: Kathleen M. Appell, c/o Howson & Howson, P.O. Box 457, Spring House, Pa. 19477

[21] Appl. No.: 258,656

[22] Filed: Oct. 17, 1988

[51] Int. Cl.[5] ..... A45D 29/00

[52] U.S. Cl. ..... 132/285; 132/73

[58] Field of Search ..... 132/73, 73.5, 285, 75

[56] References Cited

U.S. PATENT DOCUMENTS

| | | | |
|---|---|---|---|
| 474,237 | 5/1892 | Frost | 34/95.2 |
| 552,462 | 12/1895 | Beiser | 15/209 R |
| 2,179,046 | 1/1939 | Lewis | 2/21 |
| 2,180,519 | 11/1939 | Hamilton et al. | 132/285 |
| 2,251,551 | 8/1941 | O'Reilly | 2/21 |
| 2,980,940 | 9/1958 | Crowe | 15/104.94 |
| 3,369,553 | 10/1964 | Keesee | 132/73.5 |
| 4,424,822 | 1/1984 | Wilborn, II | 132/277 |
| 4,454,624 | 6/1984 | Vandermer | 15/209D |
| 4,646,953 | 3/1987 | Marshall et al. | 132/73 |

FOREIGN PATENT DOCUMENTS

| | | | |
|---|---|---|---|
| 0017268 | 4/1935 | Australia | 132/277 |
| 2748601 | 5/1979 | Fed. Rep. of Germany | 132/277 |
| 0946033 | 5/1949 | France | 132/277 |
| 0499431 | 11/1954 | Italy | 132/73 |

*Primary Examiner*—Gene Mancene
*Assistant Examiner*—Adriene B. Lepiane
*Attorney, Agent, or Firm*—Howson & Howson

[57] ABSTRACT

A device for use in removing finger nail polish while protecting the user's fingers and nails from deleterious effects of contact with nail polish remover solution. The device includes a pair of elongate imperforate channel-like members which underlie and extend between a pair of user's fingers and which mount therebelow a swab adapted to be impregnated with polish remover and rubbed against the nails having polish to be removed.

11 Claims, 1 Drawing Sheet

PROTECTIVE DEVICE FOR USE IN REMOVING FINGERNAIL POLISH

FIELD OF THE INVENTION

The present invention relates to manicuring devices, and more particularly, the present invention relates to a device for use in removing fingernail polish.

BACKGROUND OF THE INVENTION

Fingernails are kept attractive by periodic manicuring. Part of the manicuring process involves removal of old nail polish and application of new polish. Nail polish is customarily removed by means of nail polish remover solutions which dissolve the old polish. The solution is generally applied by means of a cotton swab, fabric patch, or other porous substance held between one's fingers and rubbed against the old polish.

Manicurists are particularly vulnerable to the deleterious effects of nail polish remover solution. They often sustain skin and nail damage due to continual contact with nail polish remover. A presently known commercially available device includes a container having a tubular liner of sponge rubber. The liner is impregnated with polish remover. In use, the finger tip is inserted in the container, and the finger is rotated in opposite directions relative to the container.

These devices have not been entirely satisfactory because it takes too long to remove the polish. The resulting long exposure of the finger tip to the remover solution causes the skin, cuticle and nail to dry out, and can cause skin irritation. Moreover, these devices are not particularly effective when several coats of polish are present, and they do not effectively remove polish located adjacent the cuticle. As a result, further steps are often required to remove all the polish.

U.S. Pat. Nos. 2,980,940 and 3,369,553 disclose devices for removing nail polish. U.S. Pat. Nos. 2,179,046 and 2,251,551 disclose devices for protecting freshly applied polish from being damaged while drying. U.S. Pat. No. 474,237 discloses a blotting pad adapted to be releasably secured between a person's fingers. U.S. Pat. No. 552,462 discloses a finger mounted moistening device. U.S. Pat. No. 4,454,624 discloses a scouring pad holder having finger-tip receiving cavities. None of these devices, however, either addresses the problem with which the present invention is concerned or provides a satisfactory solution.

OBJECTS OF THE INVENTION

With the foregoing in mind, a primary object of the present invention is to provide a novel device for use in removing finger nail polish while simultaneously protecting a person's fingers from substantial contact with the nail polish remover solution.

Another object of the present invention is to provide a unique device which is easy to use by professional manicurists to remove finger nail polish while simultaneously protecting their fingers and nails from continual contact with nail polish remover solution.

A further object of the present invention is to provide a protective device for use in removing nail polish, which device is simple, durable, and inexpensive to manufacture utilizing high-speed, mass production, plastic injection molding techniques.

Yet another object of the present invention is to provide a nail polish remover device which is comfortable to use and which protects a user's fingers and nails from direct contact with nail polish remover solution.

SUMMARY OF THE INVENTION

More specifically, the present invention provides a device for use in removing finger nail polish while simultaneously protecting a person's fingers from the deleterious effects of the nail polish remover solution. This device comprises a pair of elongate protective members which are adapted to be received between adjacent digits of a person's hand. Each protective member includes an upstanding web and a flange extending laterally outward from the web, the protective members being disposed with their webs in confronting relation and their flanges extending laterally outward. The protective members extend generally in the direction of the digits, and they carry gripping means below the user's digits for receiving therebetween a mass of absorbent material, such as a cotton swab. Preferably, the protective members are pivotally connected and carry teeth for releasably engaging the cotton swab to enable it to be removed and replaced periodically. Spring means biases the protective member teeth into engagement with the cotton swab. Handle means projects from the protective members for permitting them to be pivoted against the bias of the spring means. In use, the flanges keep the user's fingers straight and protect the bottoms of the user's fingers from substantial contact with nail polish remover solution and the webs protect the sides of the user's fingers. The device enables the user to apply downward pressure and a reciprocating rubbing action to remove nail polish. Preferably, the flanges and webs are sized and shaped with respect to the handle means to enable their proximal portions partially to underlie the user's palm.

BRIEF DESCRIPTION OF THE DRAWINGS

The foregoing and other objects, features and advantages of the present invention should become apparent from the following description when taken in conjunction with the accompanying drawings, in which.

DESCRIPTION OF THE PREFERRED EMBODIMENT

Figure 1:
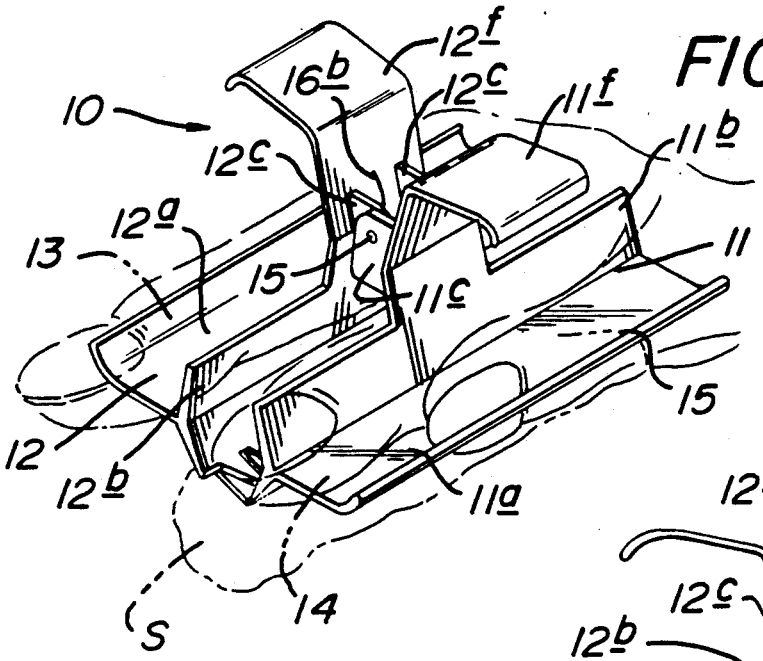
FIG. 1 is a perspective view illustrating a nail polish remover device embodying the present invention, the device being shown in full lines positioned between a manicurist's fingers and thumb which, along with a cotton swab, are shown in phantom lines.

Referring now to the drawings, FIG. 1 illustrates in full lines a protective device 10 which embodies the present invention. The protective device 10 comprises a pair of protective members 11 and 12 which are connected together to form the device 10. As will be discussed, the protective members 11 and 12 are shaped to receive and support in a substantially straight manner adjacent digits 13 and 14, and thumb 15, of a user's hand shown in phantom lines. The device 10 is adapted to carry a mass of absorbent material such as the swab of cotton S indicated in broken lines below the user's digits 13, 14 and 15.

Each protective member, such as the member 11, is horizontally elongate for receiving at least a portion of the finger of the user, and preferably for supporting the finger for its entire length. The member 11 has a horizontally extending flange portion 11*a* and an upwardly projecting web portion 11*b* formed integral therewith. The outer edge of the horizontal flange portion 11*a* may be, and preferably is, upturned as illustrated. The flange 11*a* and web 11*b* are imperforate along their lengths and cooperate to define a generally upwardly-open, finger-receiving channel best seen in FIG. 2. The horizontal flange 11*a* is adapted to be engaged by the bottom of the finger, and the upwardly projecting web 11*b* is adapted to be engaged by the side of the finger. The companion protective member 12 has a corresponding web and flange portion 12*a* and 12*b*, respectively.

In the illustrated embodiment, the protective members 11 and 12 are of a rigid material, such as plastic. They may, however, be molded of a somewhat flexible material, such as a rubber compound, so as to deform slightly to accommodate more readily the user's fingers. Also, sharp edges can be rounded where desired to enhance comfort.

Figure 2:
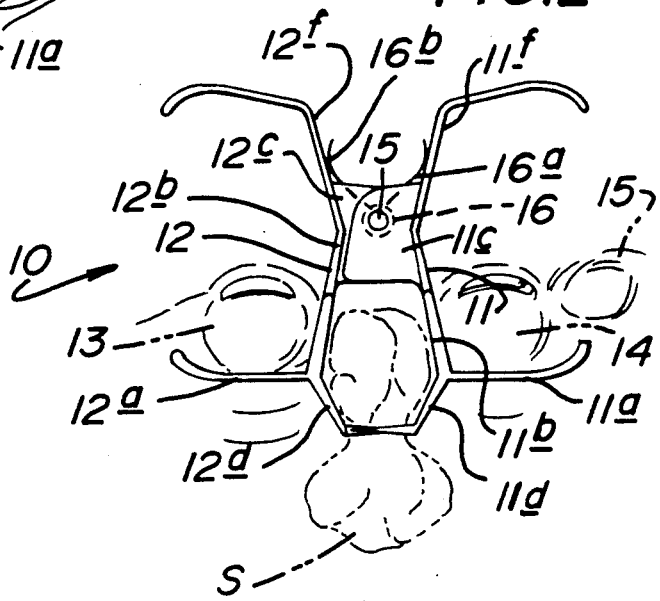
FIG. 2 is an end elevational view of the device illustrated in FIG. 1, the view looking at the distal ends of the manicurist's fingers and thumb and showing the manner in which the device grips a swab when in use.

As best seen in FIG. 2, the protective members 11 and 12 are disposed in substantially parallel relation for disposing the finger-receiving channels in corresponding relation. The protective members 11 and 12 are connected together in this relation by means of transverse interdigitated hinge elements 11*c* and 12*c* which overlap one another in the manner illustrated in FIGS. 1 and 2. A pin 15 extends through the overlapped hinge elements 11*c* and 12*c* to interconnect them and to provide a pivotal connection between the members 11 and 12 permitting them to pivot about the pin 15 for purposes to be discussed. In addition, a torsion spring 16 has its helical body portion mounted on the pin 15 and a pair of arms 16*a* and 16*b* which extend upwardly and engage the members 11 and 12 in the manner illustrated to provide a force tending to bias the member 11 clockwise and the member 12 counter-clockwise (FIG. 2).

Figure 4:
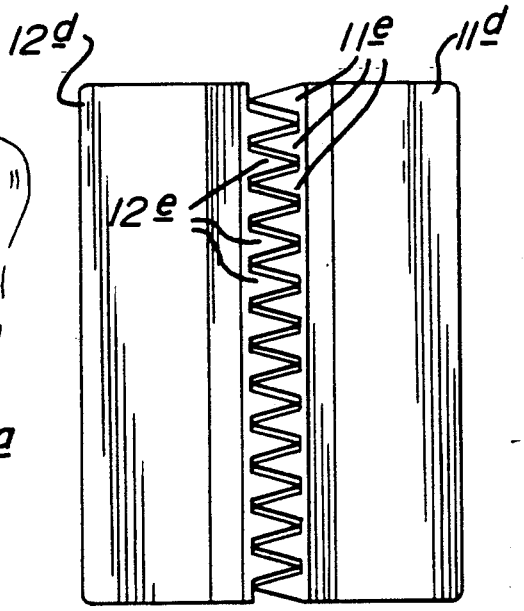
FIG. 4 is a plan view looking upwardly to illustrate certain details of the construction of the nail polish remover device.

For holding the swab S of cotton, each protective member has a lower gripping flange portion, such as the gripping flange portion 11*d* which depends below the level of the horizontal flange portion 11*a* and extends inwardly towards a corresponding gripping flange portion 12*d* of the companion protective member 12. As best seen in FIG. 2, the webs 11*b* and 12*b* converge in an upward direction toward the pivot pin 15 and the gripping flanges 11*d* and 12*d* converge below the protective flanges 11*a* and 12*a* from a common location, thereby forming a cavity for receiving a portion of the cotton swab S. The flange portions 11*d* and 12*d*, respectively, terminate in a series of inturned teeth, 11*e* and 12*e*, respectively (FIG. 4) along a vertical plane intermediate the members 11 and 12. The teeth 11*e*, 12*e* are adapted to penetrate and thereby hold the cotton swab S.

Figure 3:
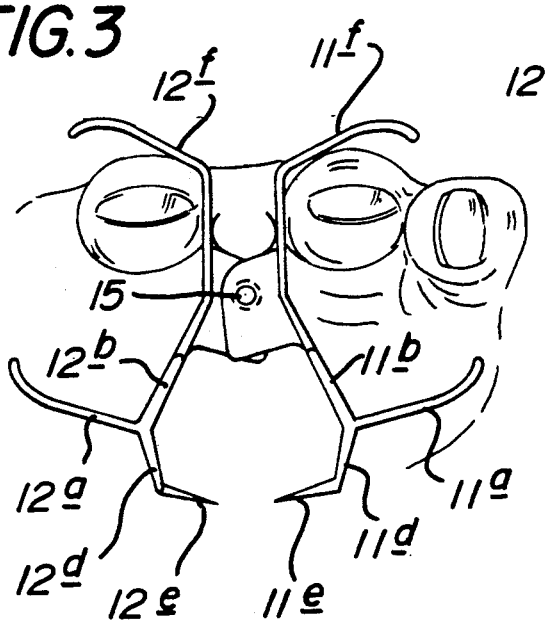
FIG. 3 is a view, similar to FIG. 2, but illustrating the device opened for disengaging the swab.

For the purpose of enabling the teeth 11*e*, 12*e* to be separated for enabling the cotton swab S to be placed therebetween, each protective member has a narrow handle portion 11*f* and 12*f* which projects upwardly above the level of the pivot pin 15 and outwardly in overlying relation with their respective horizontal flange portions 11*a* and 12*a*, forming a bight which enables inward pressure to be applied for opening the teeth. With this structure, the user can position the fingers in the manner illustrated in FIG. 3 for applying inward pressure against the bias of the torsion spring 16 to open the teeth 11*e* and 12*e* to enable the cotton swab S to be placed therebetween, and also to enable the cotton swab S to be disengaged from the device 10 after the swab S has been used.

In using the device 10, a cotton swab S is first mounted between the gripping teeth in the manner previously discussed. The cotton swab S is then impregnated with nail polish remover solution, as by placing the swab S on the top of a pump and pumping the same in a well known manner. After the swab S has been impregnated with nail polish remover solution, the user, with fingers positioned in the manner illustrated in FIGS. 1 and 2, rubs the cotton swab S across the finger nails in a reciprocating motion while applying downward pressure, in much the same manner as would be done if the cotton swab were gripped between the fingers.

The imperforate horizontal and vertical flanges of the protective device 10 causes the user's fingers to remain straight in the channels, thereby preventing the user's fingers and nails from coming into contact with the nail polish remover solution impregnated in the swab S. As a result, the user's nails and fingers are protected from the deleterious effects of the nail polish remover solution, making the device 10 particularly suited for the professional manicurist who would normally otherwise have her/his fingers and finger nails in continual contact with nail polish remover solution. After the polish has been removed in the manner described, the protective members 11 and 12 are separated in the manner illustrated in FIG. 3, and the cotton swab S dropped from between the teeth 11*e*, 12*e* to ready the device 10 for receiving a new cotton swab and a repeat of the above described process.

The device 10 is particularly effective for several reasons. First of all, the disposition of the pivot axis 15 above the level of the horizontal flanges 11*a* and 12*a* causes the teeth 11*e*, 12*e*, to be urged into firm engagement with one another when downward pressure is applied by the fingers of the user against the finger nails from which the polish is to be removed. Thus, the cotton swab S is firmly gripped by the device 10, notwithstanding repeated rubbing. Also, the handles 11*f* and 12*f* are of considerably less lengthwise extent than the protective members 11 and 12. As a result, when the handles 11*f*, 12*f* are placed in the crotch between the adjacent fingers, a portion of the palm of the user underlies the proximal ends of the horizontal flanges 11*a* and 12*a*. This enables the user's palms to apply significant downward pressure to the nails, while at the same time the handles, with portions overlying the user's fingers, prevent the device 10 from being dropped in the event the user should relax the pressure, such as when shifting the device 10 from one nail to another or while pumping additional nail polish remover solution into the swab S.

From the foregoing, it should be apparent that the protective device 10 prevents the user's finger from coming into contact with the cotton swab S and, therefore, the nail polish remover solution impregnated therein. Thus, the user's fingers are well protected from the deleterious effects of the solution. This is accomplished, however, without losing the benefits of being able to apply pressure to the finger nails and of being able to impregnate the cotton swab S with polish remover solution by using conventional pumps. As a result, the device 10 both protects the user's fingers without significantly impairing the user's customary manner of removing nail polish. Furthermore, the device 10, being of molded plastic construction, is economical to manufacture using high speed injection molding techniques.

In the illustrated embodiment, the protective members 11 and 12 are pivotally connected together to enable the cotton swab to be removed and replaced. If desired, however, the protective members could be rigidly interconnected with a cotton swab permanently mounted between the teeth to thereby provide a disposable device. The pivotal interconnection provides the advantage of enabling the device 10 to be reused.

While a preferred embodiment of the present invention has been described in detail, various modifications, alterations and changes may be made without departing from the spirit and scope of the present invention as defined in the appended claims.

I claim:

1. A device for use in removing finger nail polish, comprising:

a pair of elongate protective members having web portions adapted to being received between and to extend along confronting sides of adjacent digits of a user's hand and having flange portions substantially coextensive in length with said web portions underlying said user's digits, said web and flange portions being fluid impervious and being dimensioned lengthwise to extend from a location adjacent a crotch formed between said adjacent digits where they extend from the user's hand to a location adjacent the tips of said adjacent digits; and gripping means carried by said protective members for mounting a swab below said flange portions; said gripping means including coacting interdigitated teeth juxtaposed for penetrating, and thereby gripping, the swab;

whereby the device can be used to apply nail polish remover while protecting the user's digits from substantial contact with the nail polish remover.

2. A device according to claim 1 including means interconnecting said protective members for pivotal motion about an axis extending generally parallel to the user's digits, said gripping means including gripping flanges having juxtaposed teeth on said protective members below said flange portions thereof, and means for biasing said teeth toward one another for gripping said swab tightly therebetween.

3. A device according to claim 2 wherein said web portions and said gripping flanges bow relative to one another to form a cavity therebetween for receiving a portion of the swab when engaged by said gripping flange teeth.

4. A device according to claim 3 including handle means projecting upwardly from said web portions above said pivot axis for permitting said gripping flange teeth to be separated for releasably engaging said swab.

5. A device according to claim 2 and wherein said pivot axis is located above said protective flanges and below a handle means so that when a user's fingers are placed on the flanges to apply downward pressure they also apply inward pressure for increasing the gripping action on the swab.

6. A device according to claim 1 wherein said flanges are imperforate along their lengths so as to provide a fluid barrier between the user's digits and the swab carried between the gripping means.

7. A device according to claim 1 wherein said protective members are of molded plastic construction.

8. A device for use by a manicurist to remove nail polish from another's fingers while protecting the manicurist's own nails and fingers from the deleterious effects of nail polish remover, comprising:

a pair of elongate imperforate protective members adapted to receive adjacent digits of the manicurist and to support at least those digits lengthwise thereon in substantially parallel relation, each protective member having a flange portion underlying a digit and a web portion extending alongside a digit, said protective members being arranged in generally parallel relation with said web portions in confronting relation and with said flange portions extending laterally outward therefrom, said web and flange portions being substantially coextensive in length with one another and being dimensioned lengthwise to extend from the crotch formed between said adjacent digits to at least the tips of said digits;

gripping means provided on said protective members below the manicurist's digits for releasably clamping a swab therebetween said gripping means including coacting interdigitated teeth juxtaposed for penetrating, and thereby gripping, the swab;

means pivotally interconnecting said protective members above said gripping means so that when the manicurist's fingers are supported on the protective members they are urged toward one another into firm clamping engagement with the swab;

handle means on said protective members for permitting them to be pivoted into an open position for releasing their grip on the swab; and spring means carried by the protective members for urging them normally into gripping relation with the swab;

whereby the manicurist's fingers can be protected from direct contact with polish remover on the swab while it is moved back and forth across the nails of another.

9. A device for use in removing finger nail polish while protecting the user's fingers and nails from the deleterious effects of contact with nail polish remover solution, comprising:

means forming a pair of substantially parallel upwardly-open imperforate elongate channels, said channels each adapted to receive and support lengthwise for substantially their entire lengths adjacent digits of a user's hand, said channel forming means including a horizontally-disposed flange portion adapted to engage the bottom of a user's digit and a vertically-disposed web portion adapted to engage a side of a user's digit;

means connecting said channel forming means together in said substantially parallel relation so that said web portion extends in between said adjacent digits and said flange portions extend laterally outward therefrom; and gripping means for carrying a swab underneath said flange portions of said channels for holding nail polish remover solution, said gripping means including coacting interdigitated teeth juxtaposed for penetrating, and thereby gripping, the swab; whereby the user may apply both downward pressure and a reciprocating motion to the swab while being protected from substantial contact with the nail polish remover solution.

10. A device according to claim 9 wherein said web portion has an upwardly projecting handle section shorter than said elongate channels and engageable in the crotch formed between said adjacent digits to enable portions of said channels to underlie the user's palm.

11. A device according to claim 9 wherein said connecting means including means providing a pivot connection between said channel forming means permitting said channels to be moved into and out of said adjacent relation.

* * * * *